US005333389A

United States Patent [19]

Carroll

[11] Patent Number: 5,333,389

[45] Date of Patent: Aug. 2, 1994

[54] LETTER GUIDE APPARATUS

[76] Inventor: Robert P. Carroll, 9409 Sharondale Rd., Calimesa, Calif. 92320

[21] Appl. No.: 130,704

[22] Filed: Oct. 4, 1993

[51] Int. Cl.[5] ..... B43L 13/20

[52] U.S. Cl. ..... 33/564; 33/430; 33/27.04

[58] Field of Search ..... 33/562, 564, 565, 566, 33/435, 437, 449, 448, 477, 430, 23.11, 27.04; 101/127, 127.1

[56] References Cited

U.S. PATENT DOCUMENTS 179,686 7/1876 David ..... 33/518
4,185,392 1/1980 Berkman ..... 33/564
4,520,573 6/1985 Otten ..... 33/430 X

FOREIGN PATENT DOCUMENTS 0546200 3/1932 Fed. Rep. of Germany ..... 33/564
2059357 4/1981 United Kingdom ..... 33/564

*Primary Examiner*—William A. Cuchlinski, Jr.
*Assistant Examiner*—Alvin Wirthlin
*Attorney, Agent, or Firm*—E. Michael Combs

[57] ABSTRACT

A board member including a plurality of linear and arcuate tracks are provided, with each of the tracks including respective openings directed therethrough extending from the board top through bottom walls to permit the execution of lettering by the board to accommodate each letter of the alphabet.

1 Claim, 4 Drawing Sheets

LETTER GUIDE APPARATUS

BACKGROUND OF THE INVENTION

1. Field of the Invention

The field of invention relates to lettering guide structure, and more particularly pertains to a new and improved letter guide apparatus wherein the same is arranged to provide for a unitary board member permitting simulation of each alphabet letter.

2. Description of the Prior Art

Letter guides of various types are indicated in the prior art and exemplified by the U.S. Pat. Nos. 4,392,306; 3,584,385; as well as various stencil structure such as exemplified by U.S. Pat. No. 4,916,826, as well as U.S. Pat. No. 4,972,598.

The instant invention attempts to overcome deficiencies of the prior art by employing a unitary board member arranged to provide for the stenciling of each alphabet letter on a selective basis and in this respect, the present invention substantially fulfills this need.

SUMMARY OF THE INVENTION

The present invention provides a letter guide apparatus wherein the same is directed to the provision of a unitary board member permitting simulation of individual alphabet letters. As such, the general purpose of the present invention, which will be described subsequently in greater detail, is to provide a new and improved letter guide apparatus which has all the advantages the prior art letter guide apparatus and none of the disadvantages.

To attain this, the present invention provides a board member including a plurality of linear and arcuate tracks, with each of the tracks including respective openings directed therethrough extending from the board top through bottom walls to permit the execution of lettering by the board to accommodate each letter of the alphabet.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is another object of the present invention to provide a new and improved letter guide apparatus which may be easily and efficiently manufactured and marketed.

It is a further object of the present invention to provide a new and improved letter guide apparatus which is of a durable and reliable construction.

An even further object of the present invention is to provide a new and improved letter guide apparatus which is susceptible of a low cost of manufacture with regard to both materials and labor, and which accordingly is then susceptible of low prices of sale to the consuming public, thereby making such letter guide apparatus economically available to the buying public.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
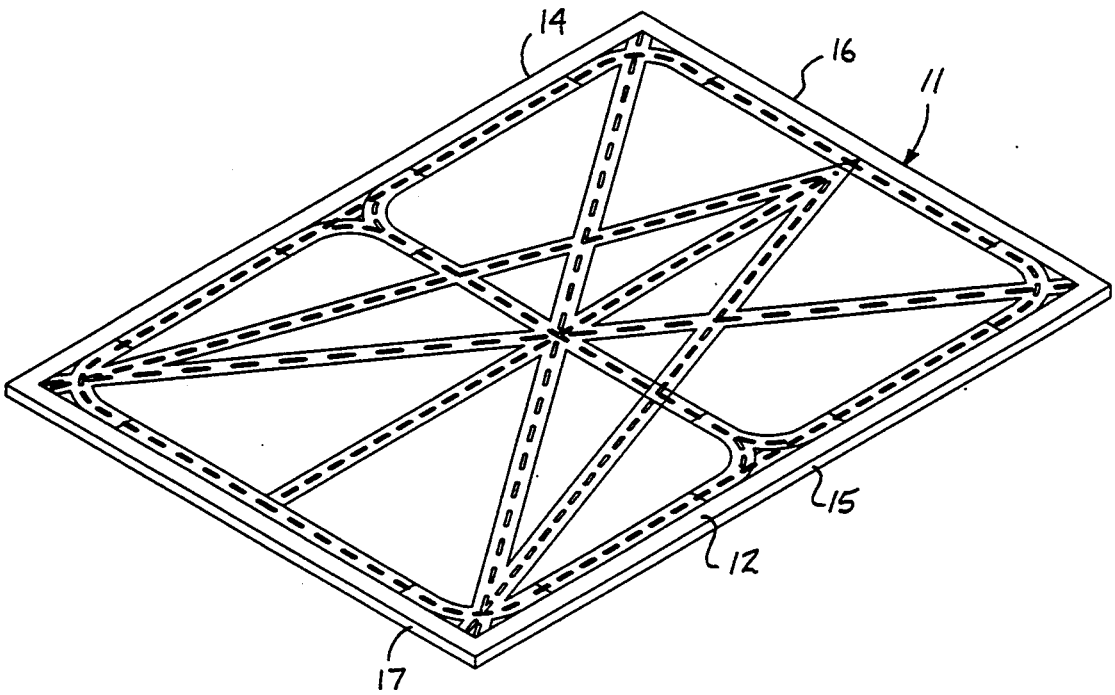
FIG. 1 is an isometric illustration of the board member of the invention.

With reference now to the drawings, and in particular to FIGS. 1 to 7 thereof, a new and improved letter guide apparatus embodying the principles and concepts of the present invention and generally designated by the reference numeral 10 will be described.

Figure 2:
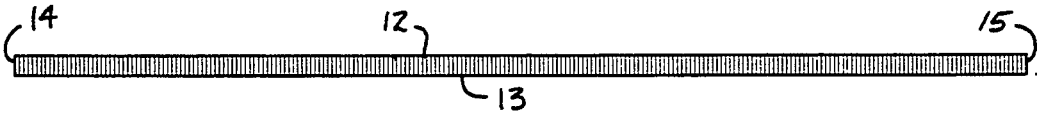
FIG. 2 is an orthographic end view of the board member.
Figure 3:
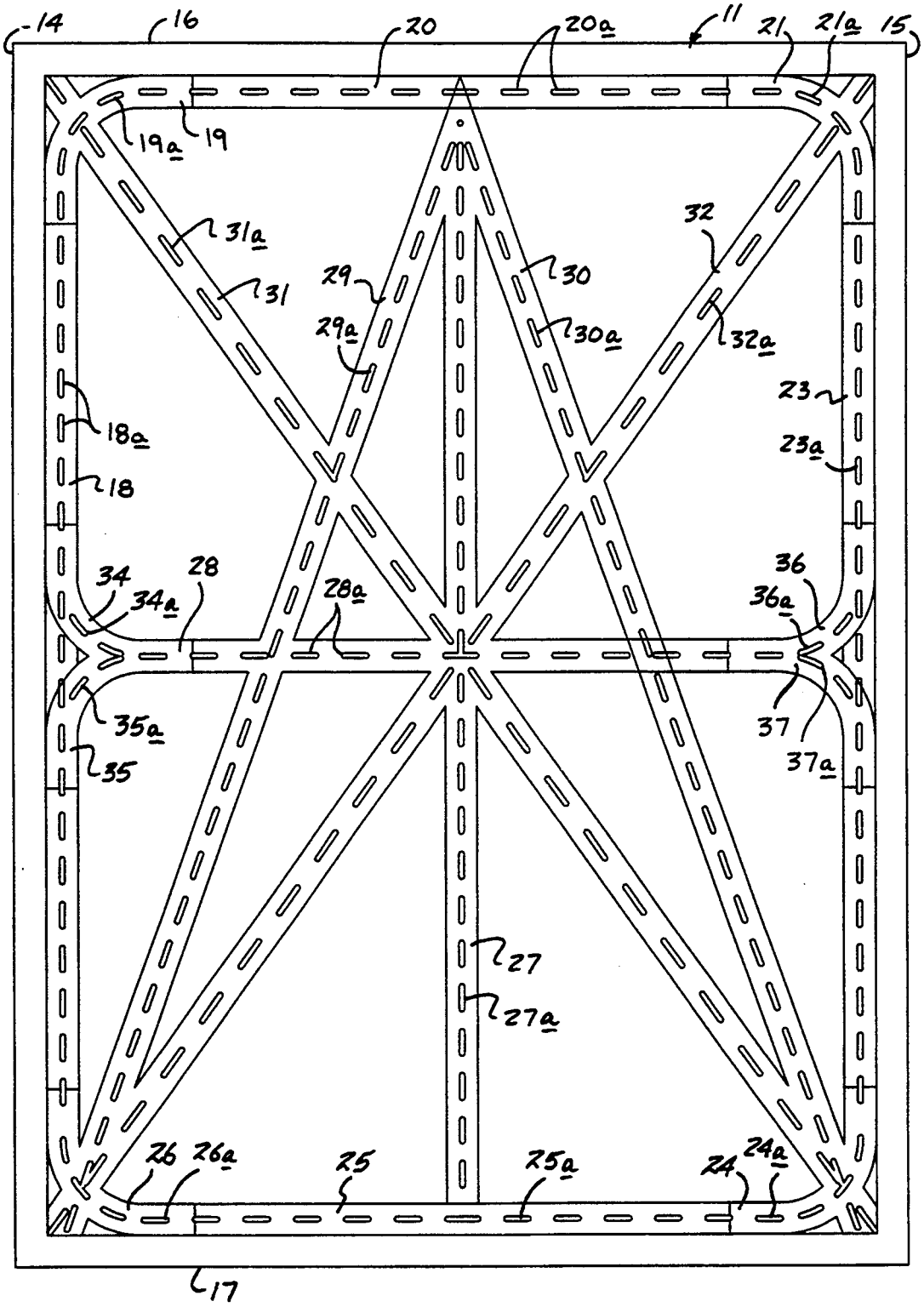
FIG. 3 is an orthographic top view of the board member indicating the various tracks and openings associated therewith.

More specifically, the letter guide apparatus 10 of the instant invention essentially comprises a rigid board member 11, as indicated in FIGS. 1–3 for example, having a top wall 12 spaced from a bottom wall 13, with a first side 14 spaced from a second side 15 and a first end 16 spaced from a second end 17. The board member is arranged to include a plurality of track members, to be described in more detail below, with each of the track members having openings extending from the top wall 12 through the bottom wall 13 to permit an individual to insert a writing instrument (not shown) through each of the respective openings for the imparting of a letter to an underlying web, such as paper and the like.

The board member, as illustrated, includes the track structure to define a rectilinear type framework, where such that a first linear track 18 having first openings 18*a* extends parallel and along the first side 14 intersecting a first arcuate track 19 having first arcuate track openings 19*a* extending from a first end of the first linear track 18 to a second linear track 20 having second openings 20*a*. The first arcuate track extends to a first end of the second track, with the second track end of the second track extending into a second arcuate track 21, having second arcuate track openings 21*a* that in turn extends from the second linear track 20 onto a first end of a third linear track 23, having third openings 23*a* extending along the second side 15 in a parallel relationship, with the first linear track 18 and the third linear track 23 in a parallel relationship relative to one another substantially coextensive relative to one another, with the second linear track 20 orthogonally oriented relative to the first and third linear tracks. A third arcuate track 24 having third arcuate track openings 24*a* extends from a second end of the third linear track from the second side 15 to the second end 17 intersecting the first end of a fourth linear track 25, that in turn has fourth openings 25*a* directed therethrough engaging and in communication with a fourth arcuate track 26 extending from a second end of the fourth linear track 25 to a second end of the first linear track 18, with the second and fourth linear tracks parallel relative to one another as illustrated. Fourth arcuate tract openings 26*a* are directed through the fourth arcuate track 26. A fifth linear track 27 medially intersects the second and fourth linear tracks, with the fifth linear track 27 fifth openings 27*a*. A sixth linear track 28 orthogonally and medially intersects the fifth linear track and oriented medially of the first and third linear tracks and spaced from the first and third linear tracks, A seventh linear track 29 extends from the fifth linear track 27 at its intersection with the second linear track, such that the seventh linear track 28 extends to and medially intersects the fourth arcuate track 26. The seventh linear track 29 having seventh openings 29*a*. An eighth linear track 30 having eighth openings 30*a* extends from the fifth linear track 27 at its intersection with the second linear track 20, such that the eighth linear track 30 medially intersects the third arcuate track 24. A ninth linear track 31 having ninth openings 31*a* extends from and medially intersects the first arcuate track 19 extending to medially intersect the third arcuate track 24. A tenth linear track 32 having tenth openings 32*a* medially intersects and extends through the second arcuate track 21 and the fourth arcuate track 26. It should be noted that the fifth linear track 27, the sixth linear track 28, the ninth linear track 31, and the tenth linear track 32 medially intersect one another at an intersection medially of the board member 11, as illustrated in FIG. 3. Fifth and sixth arcuate tracks 34 and 35 respectively having fifth and sixth arcuate track openings 34*a* and 35*a* extend from a first end of the sixth linear track 28 to the first linear track 18, while seventh and eighth arcuate tracks 36 and 37 having respective seventh and eighth arcuate track openings 36*a* and 37*a* extend from a second end of the sixth linear track 28 to the third linear track 23. The fifth and sixth arcuate tracks 34 and 35 extending from the sixth linear track 28 define a first T-shaped configuration, while a second T-shaped configuration is formed with the seventh and eighth arcuate tracks 36 and 37 respectively extending from the second end of the sixth linear track 28 to the third linear track 23.

In this manner, any of the alphabet letters of the English alphabet may be duplicated by the letter guide apparatus indicated by the board member 11.

Figure 4:
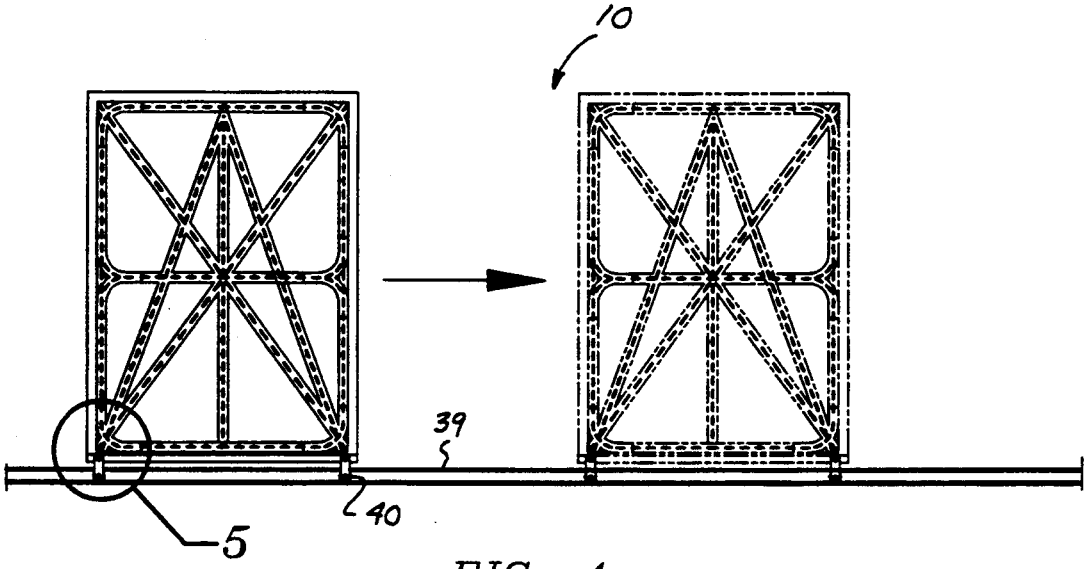
FIG. 4 is an orthographic view of the invention including a guide track structure for the board member.
Figure 5:
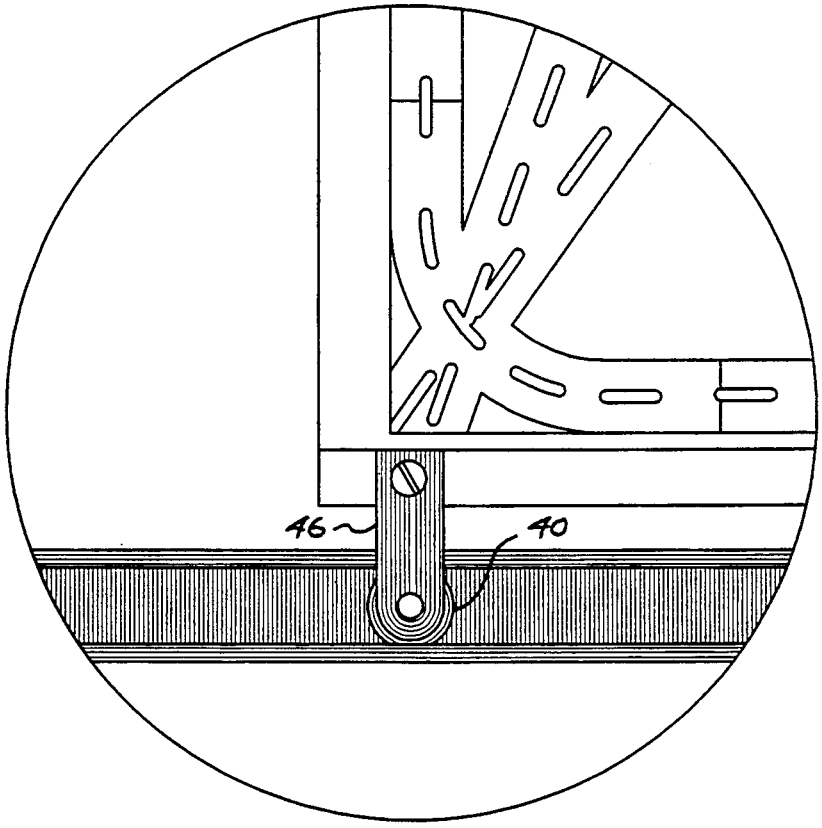
FIG. 5 is an enlarged orthographic view of section 5 as set forth in FIG. 4.
Figure 6:
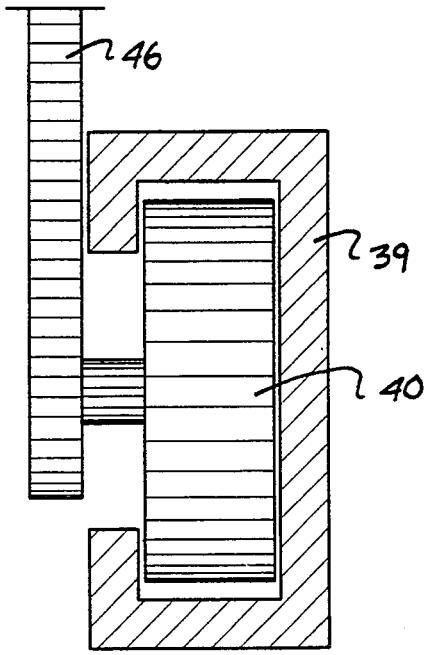
FIG. 6 is an orthographic end view of the guide and wheel structure.
Figure 7:
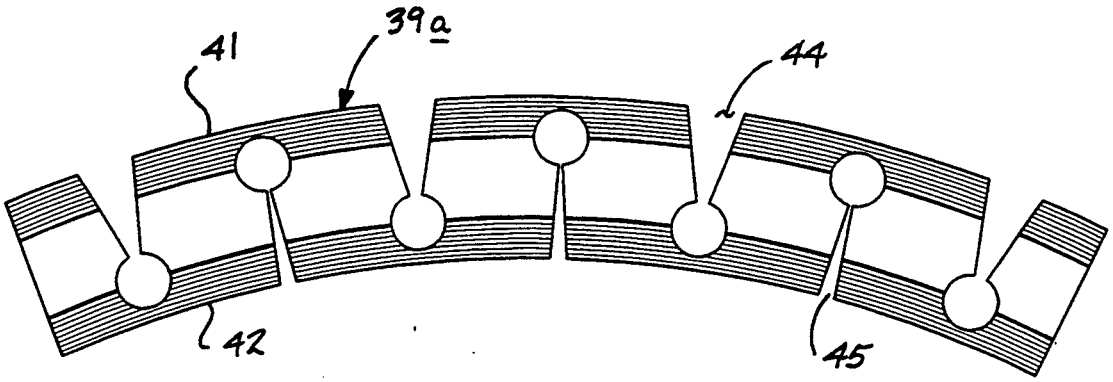
FIG. 7 is an orthographic view of a modified guide track structure for receiving the wheels of the board member, in a manner as indicated in FIG. 6.

The FIGS. 4 and 5 indicate the board member second end having a plurality of wheel support flanges 46 rotatably mounting an individual wheel 40 received within the guide track 39. The guide track 39 may be indicated in the modified form 39*a*, as indicated in FIG. 7, permitting flexure and curving of the guide track to accommodate various positioning of letters in an arcuate array, such that the guide track having guide track first and second sides 41 and 42 respectively include respective first and second keyhole slots 44 and 45 extending into the modified guide track 39*a* from the guide track first and second sides 41 and 42 to permit the flexing of the guide track in an arcuate manner, as indicated in FIG. 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A letter guide apparatus, comprising, a board member, having a top wall spaced from a bottom wall, a first side spaced from a second side, and a first end spaced from a second end, including a first linear track having first openings directed therethrough, with said first linear track extending along said first side, the apparatus further including a second linear track, a third linear track, a fourth linear track, a fifth linear track, and a sixth linear track, the third linear track parallel to said first linear track and coextensive therewith extending along said second side coextensive with said first linear track, and the second linear track extending along said first end orthogonally oriented relative to said first track and said third track, and the fourth linear track extending along said second end parallel to said second track, with said fourth track extending between said first track and said third track, and a first arcuate track extending between said first linear track and said second linear track, and a second arcuate track extending from said second linear track to said third linear track, and a third arcuate track extending from said third linear track to said fourth linear track, and a fourth arcuate track extending from said fourth linear track to said first linear track, said second linear track having second openings projecting therethrough, said third linear track having third openings directed therethrough, and said fourth linear track having fourth openings therethrough, and said first arcuate track having first arcuate track openings directed therethrough, said second arcuate track having second arcuate track openings directed therethrough, said third arcuate track having third arcuate track openings directed therethrough, and said fourth arcuate track having fourth arcuate track openings directed therethrough, and the fifth linear track oriented parallel to and positioned between said first linear track and said third linear track, with said fifth linear track medially oriented orthogonally between said second linear track and said fourth linear track, and the sixth linear track extending orthogonally between said first linear track and said third linear track, and a fifth arcuate track and a sixth arcuate track extending from said sixth linear track, with said fifth arcuate track and said sixth arcuate track extending to and intersecting the first linear track defining a first T-shaped configuration with said sixth linear track, and a seventh arcuate track and an eighth arcuate track extending from said sixth linear track and intersecting the third linear track, with the seventh arcuate track and the eighth arcuate track defining a second T-shaped configuration with said sixth linear track, and a seventh linear track extending from a first intersection of said fifth linear track with said second linear track, with the seventh linear track extending from said first intersection medially intersecting the fourth arcuate track, and an eighth linear track extending from said first intersection and medially intersecting the third arcuate track, and a ninth linear track extending from and intersecting the first arcuate track and extending to and intersecting the third arcuate track and the eighth linear track, and a tenth linear track extending from and medially intersecting the second arcuate track directed through and medially intersecting the fourth arcuate track, and the fifth linear track includes fifth openings, the sixth linear track includes sixth openings, the seventh linear track includes seventh openings, the eighth linear track includes eighth openings, the ninth linear track includes ninth openings, the tenth linear track includes tenth openings, the fifth arcuate track includes fifth arcuate track openings, the sixth arcuate track includes sixth arcuate track openings, the seventh arcuate track having seventh arcuate track openings, and the eighth arcuate track having eighth arcuate track openings directed therethrough, and the board member second end has a plurality of wheel support flanges, with each of said wheel support flanges rotatably mounting a wheel member thereon, and a guide track, with each wheel member received within said guide track in a rotative relationship, and said guide track includes a guide track first side and a guide track second side, with the guide track first side including a row of first keyhole slots directed into said guide track from said guide track first side, and a row of second keyhole slots directed into the guide track from the guide track second side.

* * * * *